US006097905A

United States Patent [19]

Watanabe et al.

[11] Patent Number: 6,097,905

[45] Date of Patent: Aug. 1, 2000

[54] IMAGE HEATING APPARATUS

[75] Inventors: Yukio Watanabe, Machida; Shigemichi Hamano, Shizuoka-ken, both of Japan

[73] Assignee: Canon Kabushiki Kaisha, Tokyo, Japan

[21] Appl. No.: 09/382,389

[22] Filed: Aug. 25, 1999

[30] Foreign Application Priority Data

Aug. 31, 1998 [JP] Japan ..... 10-245220

[51] Int. Cl.[7] ..... G03G 15/20

[52] U.S. Cl. ..... 399/69; 219/216; 399/335

[58] Field of Search ..... 399/67, 68, 69, 399/70, 122, 320, 328, 330, 331, 332, 335; 219/216

[56] References Cited

U.S. PATENT DOCUMENTS 5,543,904 8/1996 Kato et al. ..... 399/335

*Primary Examiner*—Arthur T. Grimley
*Assistant Examiner*—Hoan Tran
*Attorney, Agent, or Firm*—Fitzpatrick, Cella, Harper & Scinto

[57] ABSTRACT

For use in a copying apparatus or the like, there is provided an image heating apparatus having a first heater, a second heater, and a power supply control device for controlling the power supply to the first and second heaters, wherein the power supply control unit is adapted, in case of power supply to both of the first and second heaters, to at first start power supply to the first heater and then to the second heater, and, in case of power supply again to both of the first and second heaters, to at first start power supply to the second heater and then to the first heater.

6 Claims, 3 Drawing Sheets

IMAGE HEATING APPARATUS

BACKGROUND OF THE INVENTION

1. Field of the Invention

The present invention relates to an image heating apparatus for heating an image on a recording material, and more particularly to an image heating apparatus adapted for use as a fixing apparatus in a copying apparatus or a printer.

2. Related Background Art

Conventionally the temperature control of the fixing apparatus has been executed for the target temperature only, independently from the function of the main apparatus such as the copying apparatus.

However, based on the standpoint of saving the entire power consumption in the copying apparatus, there is recently made an attempt to alter the temperature control for the fixing apparatus by a signal synchronized with the function of the main apparatus. More specifically, in case the electric power is required in another unit (for example the original illuminating lamp) in the copying apparatus while the heater of the fixing apparatus is turned on, the electric power consumption in the fixing apparatus is lowered during the corresponding period.

While a lower power consumption is desired, the restriction on flicker etc. is becoming stricter year after year. As the flicker depends on the magnitude of the electric power supplied to the load and the cycle of electric power input, the apparatus has to be designed in consideration of the balance of these factors.

In the following there will be explained, with reference to FIGS. 2, 3 and 5, the configuration of a fixing apparatus in consideration of the electric power consumption and the countermeasure against flicker, and an example of the control therefor. This apparatus is to control upper and lower two heaters based on the temperature detected by a thermistor positioned at the side of a pressure roller. The thermistor at the side of the pressure roller is provided for detecting the excessive temperature rise in a sheet non-passing area of the fixing roller.

Referring to FIG. 2, at the start of the fixing temperature control, in order to raise the fixing unit to a predetermined temperature, the heater of the fixing roller is controlled (turned on in this case) based on the temperature of the pressure (lower) roller. Then, after a predetermined time (1 second in this case), the heater of the pressure roller is controlled (turned on in this case) based on the temperature of the pressure (lower) roller.

Since the electric power supply to the two heaters is not started at the same time but is mutually displaced to reduce the electric power input at a time. Also the flicker can be made less conspicuous as the electric power is turned on at a relatively long cycle time.

FIG. 3 shows a state, under such control, when the fixing temperature control is altered by an external interruption, namely by the electric power consumption in another load.

Also in this case, at the start of fixing temperature control, the heater of the fixing roller is controlled (turned on in this case) based on the temperature of the pressure (lower) roller. After a predetermined time (1 second in this case), the heater of the pressure roller is controlled (turned on in this case) based on the temperature of the pressure (lower) roller. If an interruption signal is received in this state, the temperature control method for the fixing apparatus is altered (by alternate activation of the upper and lower heaters).

When the interruption signal is terminated thereafter, the original fixing temperature control is restored. In this case the control is started from the initial state, so that the heater of the fixing roller is at first controlled (turns on in this case) based on the temperature of the pressure (lower) roller. After a predetermined time interval (1 second in this case), the heater of the pressure roller is controlled (turned on in this case) based on the temperature of the pressure (lower) roller.

Therefore, in case the interruption signals arrive at an interval of about 3 seconds, the upper heater alone is turned on for 1 second after the termination of the interruption signal as shown in FIG. 3, so that the upper heater is turned on for an approximately doubled period. As a result, the fixing roller becomes deviated from the target temperature, resulting in drawbacks such as an offset phenomenon or a shortened service life of the fixing roller.

SUMMARY OF THE INVENTION

In consideration of the foregoing, an object of the present invention is to provide an image heating apparatus capable of providing approximately same service lives for two heaters.

Another object of the present invention is to provide an image heating apparatus of a low electric power consumption.

Still another object of the present invention is to provide an image heating apparatus with appropriate countermeasure against the flicker phenomenon.

Still another object of the present invention is to provide an image heating apparatus comprising:

a first heater;

a second heater; and power supply control means for controlling a power supply to the first and second heaters;

wherein the power supply control means is adapted to start power supply to the second heater after starting of power supply to the first heater in case where power is supplied to both of the first and second heaters, and to start power supply to the first heater after starting of power supply to the second heater in case where power is supplied again to both of the first and second heaters.

Still other objects of the present invention, and the features thereof, will become fully apparent from the following detailed description which is to be taken in conjunction with the attached drawings.

DETAILED DESCRIPTION OF THE PREFERRED EMBODIMENTS

Figure 5:
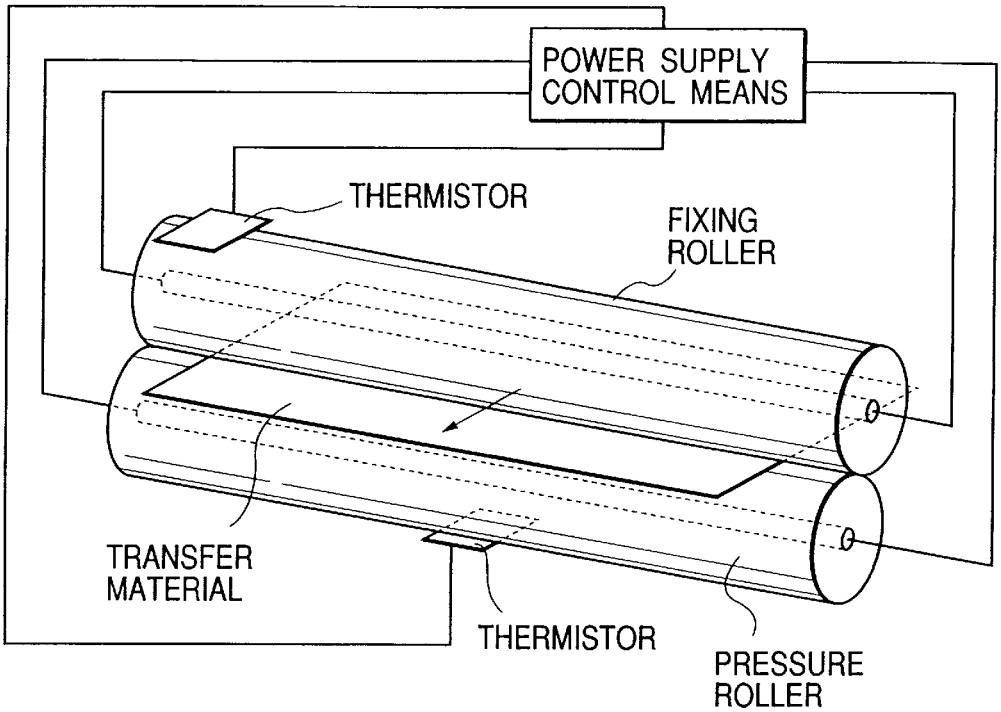
FIG. 5 is a schematic view showing the configuration of a fixing apparatus.

Now the present invention will be clarified in detail with reference to the attached drawings. The configuration of the fixing apparatus, being same as that shown in FIG. 5, will be explained with reference thereto.

[First embodiment]

Figure 1:
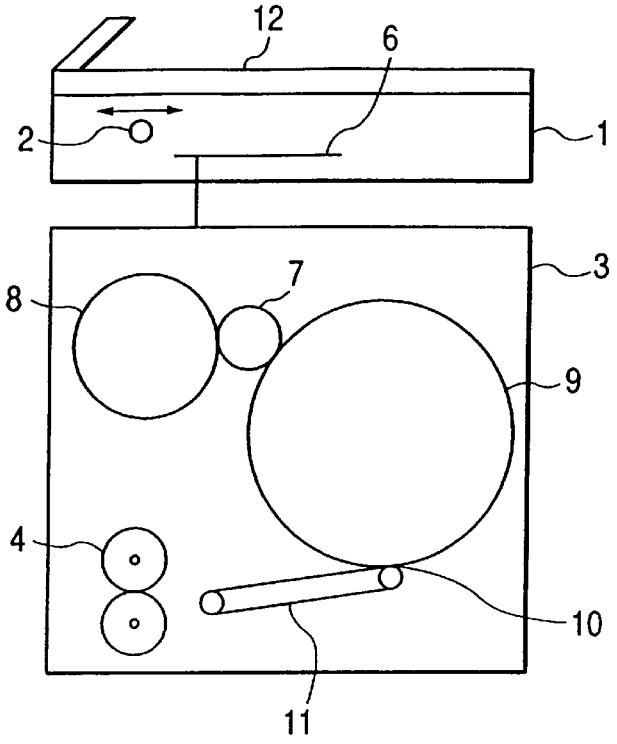
FIG. 1 is a view showing the entire configuration of an image forming apparatus of the present invention.

FIG. 1 illustrates an image forming apparatus including a fixing apparatus of the present invention. An original is illuminated with a light source 2 (a fluorescent lamp), and the reflected light is converted by a photoelectric converting element such as CCD into an image signal, which is supplied, after appropriate conversion in a reader controller 6, to a printer unit 3.

Based on the image signal from the reader controller 6, the printer unit 3 executes image exposure on a photosensitive drum 7 to form an electrostatic latent image, which is then visualized by toner image in a developing unit 8. The toner image then primary transferred onto an intermediate transfer drum 9, and is then transferred in a secondary transfer unit 10 onto a transfer material. The transfer material bearing the toner image is conveyed by a transfer belt 11 to a fixing apparatus 4, in which the toner image is fixed to the transfer material under heat and pressure.

For preventing flicker in the power supply, the temperature detection for controlling the temperature of the fixing apparatus is renewed at a relatively long interval, for example about 1 second.

Figure 2:
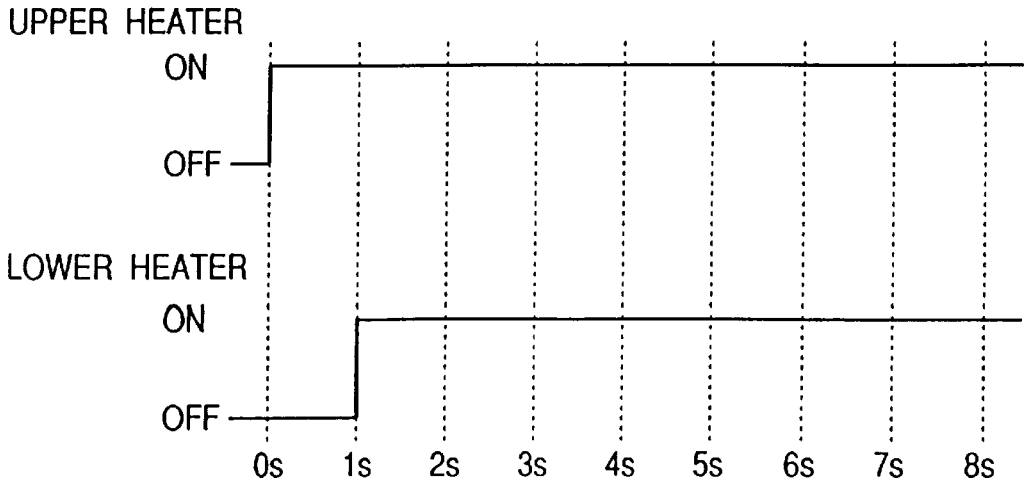
FIG. 2 is a chart showing the conventional temperature control method for the fixing apparatus (in the absence of interruption signal)
Figure 3:
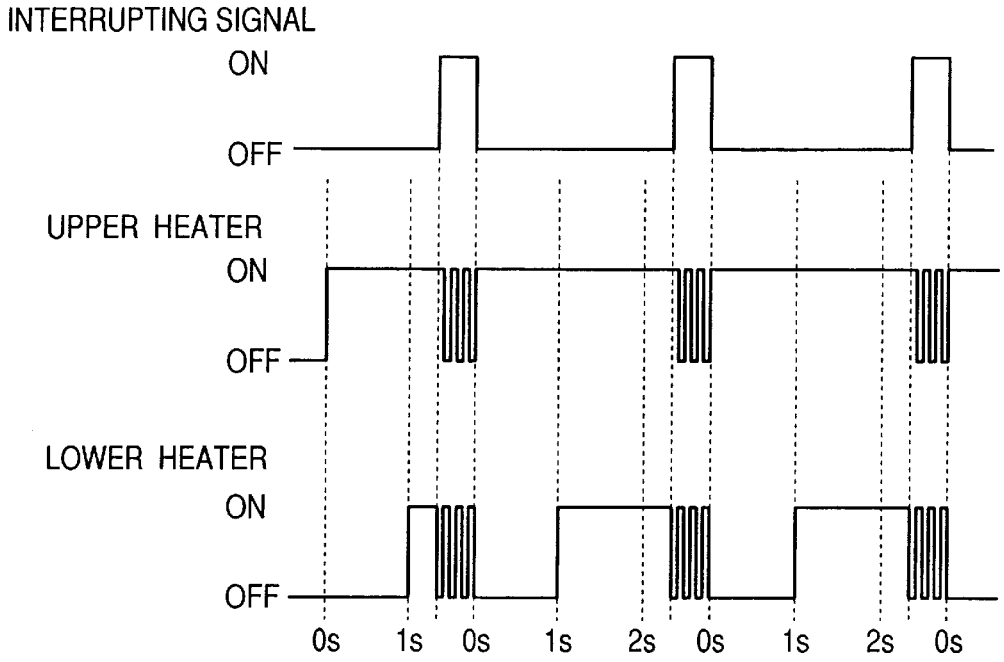
FIG. 3 is a chart showing the conventional temperature control method for the fixing apparatus (in the presence of interruption signal)

At the start of fixing temperature control for the fixing apparatus 4, the heater of the fixing roller is controlled based on the temperature detected by the thermistor provided at the pressure roller. After a period of 1 second from the control of the heater of the fixing roller, the heater of the pressure roller is controlled based on the temperature detected by the thermistor of the pressure roller (cf. FIG. 2).

If the original reading operation is executed in the original reader unit during the power supply to both heaters, the electric power is also consumed in the original reader unit. In the copying apparatus of the present embodiment, the light source (fluorescent lamp) moves along the original (forward scan) in the turned-on state whereby the original is read. After the original reading, the light source in the turned-on state returns to the home position (back scan) with a speed higher than in the forward scan. The light source remains in the turned-on state during the back scan, because the light source, being composed of a fluorescent lamp, requires a certain time for reaching the predetermined intensity from the extinguished state. Consequently, in case of reading plural originals in continuation, the light source is not turned off during the back scan but is preferably turned on continuously in order to shorten the original reading time.

An original conveying device (auto document feeder) 12 conveys the plural originals stacked thereon one by one at the timing of back scanning of the light source 2.

The copying apparatus of the present embodiment is so designed that the entire electric power consumption in the copying apparatus does not exceed a predetermined value even if the forward scanning operation is executed while both heaters of the fixing apparatus are turned on.

However, the entire electric power consumption of the copying apparatus may exceed the predetermined value if the back scanning operation, requiring a higher electric power consumption than in the forward scanning operation, is executed while both heaters of the fixed apparatus are turned on.

Figure 4:
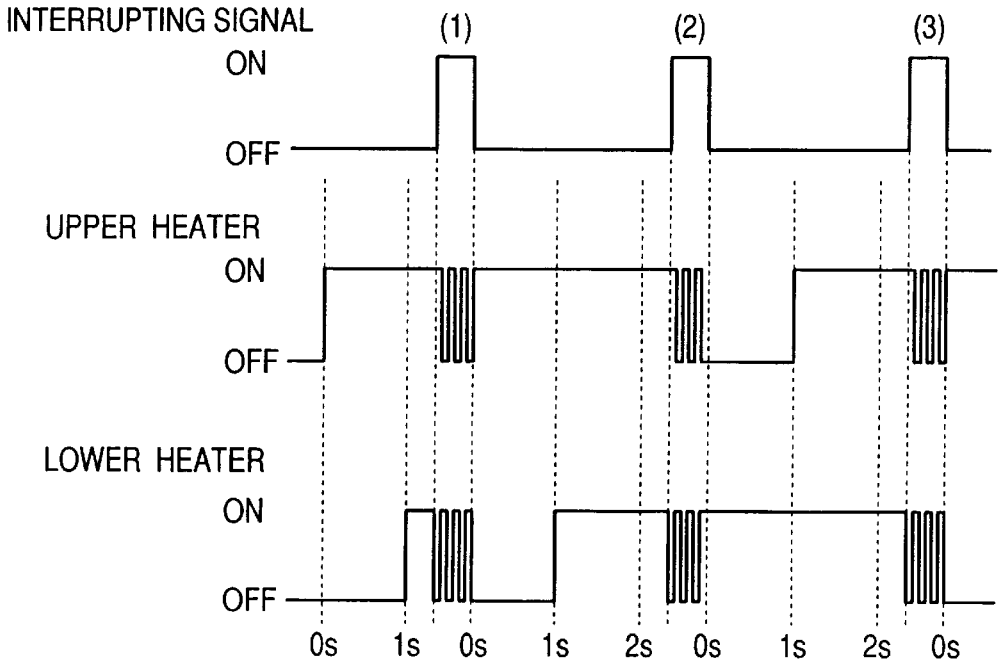
FIG. 4 is a chart showing the temperature control method in a fixing apparatus of a first embodiment of the present invention (in the presence of interruption signal)

Therefore, an interruption signal is generated at the start of the back scan of the light source 2 of the original reading unit 1 to alter the temperature control method of the fixing apparatus 4 (alternate turn-on of the upper and lower heaters). The external signal supplied to the fixing apparatus can be not only the signal synchronized with the back scan but also a signal synchronized with the original exchange or a signal synchronized with on/off operation of the light source. When the interruption is terminated thereafter, the original temperature control is restored but the heaters of the rollers are controlled in a manner different from the previous control, as will be explained with reference to FIG. 4.

More specifically, in heating the fixing apparatus to the predetermined temperature, the power supply is started at first to the upper heater, and, after a period of 1 second, then to the lower heater. When an interruption signal (1) is inputted into the controller of the fixing apparatus at the start of back scanning operation of the light source 2, the upper and lower heaters are alternately turned on to reduce the electric power consumption in the fixing apparatus.

When the interruption signal (1) is terminated, the upper heater is turned on, and, after 1 second, the lower heater is turned on.

Then, in response to the input of an interruption signal (2), the upper and lower heaters are alternately turned, and, when the interruption signal (2) is terminated, the lower heater is turned on prior to the upper heater, in contrast to the state after the termination of the interruption signal (1). Then, after 1 second, the upper heater is turned on.

Also after the termination of an interruption signal (3), the upper heater is turned on at first and the lower heater is turned on after 1 second, in contrast to the state after the termination of the interruption signal (2).

As explained in the foregoing, in case of power supply to both of the first and second heaters, the power supply is at first started to the first heater and then to the second heater, and in case of power supply again to both of the first and second heaters, the power supply is at first started to the second heater and then to the first heater, whereby the turn-on time can be approximately same for both heaters so that the service life can also be approximately same therefor.

As a result it is rendered possible to prevent a situation where the service life expires only in one of the heaters and thus to suppress the reduction in the service life of the entire apparatus.

[Second embodiment]

Figure 6:
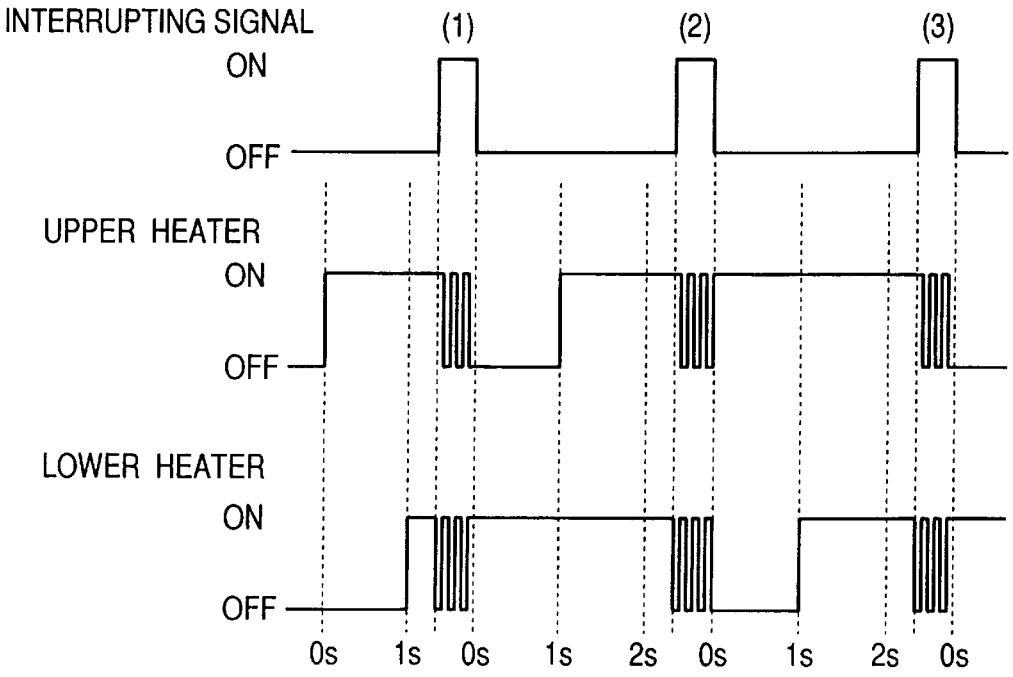
FIG. 6 is a chart showing the temperature control method in a fixing apparatus of a second embodiment of the present invention.

FIG. 6 is a chart showing the control in a second embodiment of the present invention.

In this embodiment, in heating the fixing apparatus to the predetermined temperature, the power supply is started at first to the upper heater and then to the lower heater after 1 second, as in the first embodiment. After the termination of the interruption signal (1), the lower heater is turned on earlier than the upper heater. Thereafter the order of start of power supply to the heaters is alternated whenever both heaters are powered.

Since the order of start of power supply after the termination of the interruption signal (1) is inverted from the order of start of initial power supply for the initial activation of the fixing apparatus, the turn-on times of the heaters can be made more uniform than in the first embodiment.

The present invention is not limited to the foregoing embodiments but is subject to any and all modifications within the scope of the same technical concept.

What is claimed is:

1. An image heating apparatus comprising:

a first heater;

a second heater; and power supply control means for controlling a power supply to said first and second heaters;

wherein said power supply control means controls the power supply to start power supply to said second heater after starting of power supply to said first heater in case where power is supplied to both of said first and second heaters, and to start power supply to said first heater after starting of power supply to said second heater in case where power is supplied again to both of said first and second heaters.

2. An image heating apparatus according to claim 1, wherein said power supply control means, in case where an interruption signal is inputted to said power supply control means in the course of power supply to both of said first and second heaters, controls the power supply so as to reduce a power consumption of said first and second heaters.

3. An image heating apparatus according to claim 2, wherein said power supply control means in case where power is supplied again to both of said first and second heaters after termination of the interruption signal, starts power supply to said first heater after starting of power supply to said second heater.

4. An image heating apparatus according to claim 2, said image heating apparatus for use in a copying apparatus including a reading unit for reading a document, wherein the interruption signal is inputted into said power supply control means in response to a movement of said reading unit.

5. An image heating apparatus according to claim 2, said image heating apparatus for use in a copying apparatus including a reading unit for reading a document and a conveying unit for conveying the document to said reading unit, wherein the interruption signal is inputted into said power supply control means in response to a movement of said conveying unit.

6. An image heating apparatus according to claim 2, wherein said power supply control means, in case an interruption signal is inputted into said power supply control means in the course of power supply to both of said first and second heaters, supplies power alternately to said first and second heaters.

* * * * *